United States Patent [19]

Akita et al.

[11] Patent Number: 4,458,885

[45] Date of Patent: Jul. 10, 1984

[54] QUENCHING APPARATUS FOR STEEL PIPES

[75] Inventors: Shinji Akita, Yokohama; Haruyuki Nakanishi, Chigasaki, both of Japan

[73] Assignee: Nippon Kokan Kabushiki Kaisha, Tokyo, Japan

[21] Appl. No.: 373,002

[22] Filed: Apr. 29, 1982

[30] Foreign Application Priority Data

May 6, 1981 [JP] Japan ..... 56-66933

[51] Int. Cl.[3] ..... C22C 9/08

[52] U.S. Cl. ..... 266/117; 148/155

[58] Field of Search ..... 266/114, 117, 111–113; 148/143, 153, 155, 157; 266/133, 134, 259

[56] References Cited

U.S. PATENT DOCUMENTS

| | | | |
|---|---|---|---|
| 3,294,599 | 12/1966 | Huseby | 266/114 |
| 3,623,716 | 7/1983 | Fritsch et al. | 148/153 |
| 3,804,390 | 4/1974 | Jennings et al. | 266/117 |
| 3,877,685 | 4/1975 | Franceschina et al. | 266/114 |
| 3,937,448 | 2/1976 | Fujii et al. | 266/114 |

FOREIGN PATENT DOCUMENTS

| | | | |
|---|---|---|---|
| 53-125917 | 2/1978 | Japan | 148/143 |

*Primary Examiner*—L. Dewayne Rutledge
*Assistant Examiner*—Christopher W. Brody
*Attorney, Agent, or Firm*—Michael N. Meller

[57] ABSTRACT

A quenching method and apparatus for quenching a steel pipe heated throughout the length thereof to a given quenching temperature in which during cooling of the steel pipe, the pipe is rotated or the pipe is moved axially while rotating it thereby uniformly cooling the entire pipe. The apparatus is incorporated as an in-line equipment in a steel pipe production line whereby a steel pipe introduced from the preceding processing stage is quenched by the said quenching method and is then delivered automatically to the following processing stage thereby uniformly cooling the steel pipe in the lengthwise direction thereof and reducing the quenching time.

3 Claims, 7 Drawing Figures

QUENCHING APPARATUS FOR STEEL PIPES

BACKGROUND OF THE INVENTION

The present invention relates to a quenching apparatus used in conjunction with a quenching method for steel pipes which have been heated all over the length thereof to a given quenching temperature and more particularly in a conjunction with a quenching method so designed that during the cooling of a steel pipe, the pipe is rotated or the pipe is moved axially while rotating it and thus the whole pipe is cooled uniformly. This quenching apparatus can be incorporated as an in-line equipment in a steel pipe production line such that a steel pipe introduced from a preceding processing stage is quenched by the above-described quenching method and then the pipe is delivered automatically to the following processing stage, thereby uniformly cooling the pipe in the lengthwise direction and reducing the quenching time.

The quenching methods heretofore known for quenching steel pipes heated throughout the length thereof to a given quenching temperature include the following typical methods: (1) Outer surface quenching using ring nozzles; (2) inner surface quenching which sprays water from the end of a steel pipe; and (3) method of placing a steel pipe in a water tank and spraying a jet of water into the pipe from a nozzle positioned near the end of the pipe.

In this case, if a thick-walled steel pipe is quenched by the method (1), it is impossible to ensure a satisfactory cooling rate and moreover, due to variations in the amount of sprayed cooling water among the plurality of cooling water spray rings or among the ring peripheral positions or due to any misalignment between the central axis of the rings and that of a steel pipe to be quenched, the cooling rate of the steel pipe becomes nonuniform so that a warpage is caused in the pipe and this warpage, if large enough, not only causes inconvenience to the quenched steel pipe itself but also tends to cause damage to the quenching equipment. Also, the method requires a large quantity of cooling water. In the case of the method (2), while the required amount of cooling water is small as compared with the method (1), it is impossible to ensure a sufficient cooling rate for the quenching of thick-walled steel pipes and moreover any deflection in a steel pipe between its supporting beds has a considerable effect on the straightness of the steel pipe after the quenching. Further, the cooling rate is high on the entry side and low on the exit side with the result that the cooling rate becomes nonuniform in the lengthwise direction and this makes the quenching of long pipes difficult. While the method (3) has been devised to overcome the deficiencies of the methods (1) and (2), this method is also disadvantageous in that the nozzle provided inside the water tank is at some distance from the end of a steel pipe thus making it impossible to ensure a sufficient cooling water velocity within the pipe due to the resistance of the water in the tank, and that the upper and lower surface conditions of the steel pipe in the tank are not the same thus making it impossible to ensure uniform surface cooling of the pipe in both the lengthwise and circumferential directions. This fact is a decisive disadvantage for cooling steel pipes, particularly long pipes. Thus, all of the known methods present many difficulties.

Also, attempts have recently been made to incorporate a quenching apparatus in a steel pipe production line for online operation and thus a clamping device used with such quenching equipment is required that it is capable of operating at high speeds, clamping a steel pipe with its end face being pressed against the end face of a nozzle, clamping the pipe positively without the danger of the pipe being dislocated by the supply water or the like and so on. However, the clamping devices heretofore known in the art do not necessarily meet these requirements.

Another requirement is that steel pipes to be quenched vary in size ranging from small-diameter pipes to large-diameter pipes and these various pipes must be clamped in such a manner that the center of a pipe aligns with the center of the quenching head. In this case, while the method of holding the quenching head in place and vertically moving the supports of the pipe and the method of holding the supports of the pipe in place and vertically moving the quenching head are conceivable. However, due to a narrow range of vertical adjustments of the known equipment, it has been impossible to adapt them for steel pipes in a wide range of sizes and moreover the construction is complicated thus requiring troublesome arrangements and making it difficult to effect the desired alignment in a short period of time.

SUMMARY OF THE INVENTION

The present invention has been made with a view to overcoming the above-mentioned deficiencies in the prior art, and it is an object of the invention to provide a quenching apparatus by which either the outer surface or inner surface or both of a steel pipe are cooled by applying a cooling water thereto and also during the cooling the steel pipe is rotated and moved in the lengthwise direction, thereby uniformly cooling the entire length of the steel pipe in a short period of time.

It is another object of the invention to provide a clamping mechanism which is simple in construction, quick in response and capable of positively clamping a steel pipe in such a manner that the end face of the steel pipe is pressed against the end face of a nozzle.

It is still another object of the invention to provide a centering mechanism for holding supporting means of a steel pipe in place and vertically moving a quenching head so as to align their centers with each other easily and in a short period of time.

DESCRIPTION OF THE PREFERRED EMBODIMENT

The present invention will now be described in greater detail with reference to the illustrated embodiment.

Figure 1:
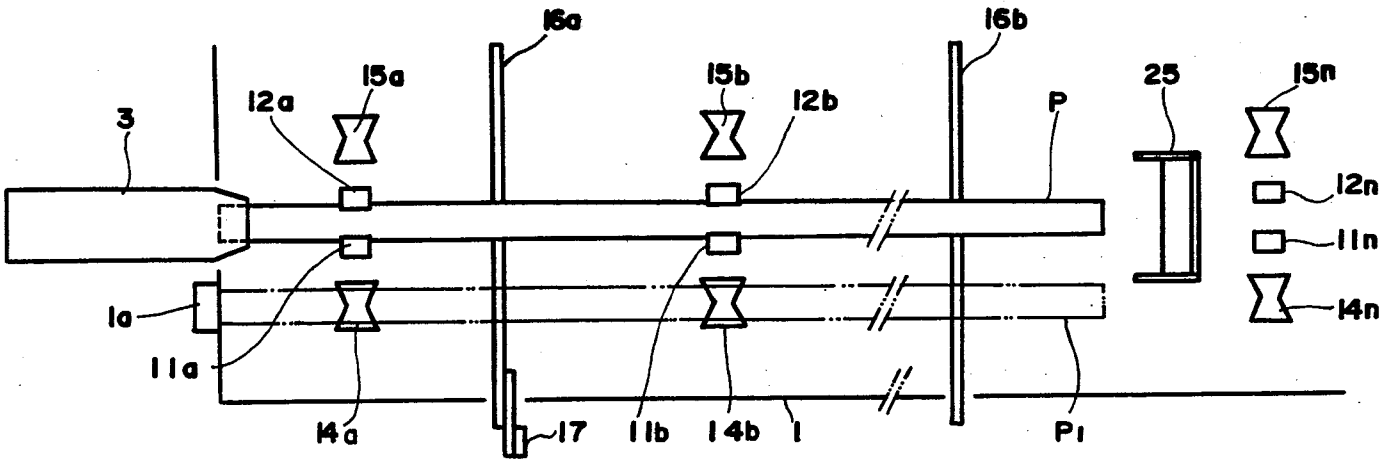
FIG. 1 is a schematic plan view showing an embodiment of the invention.
Figure 2:
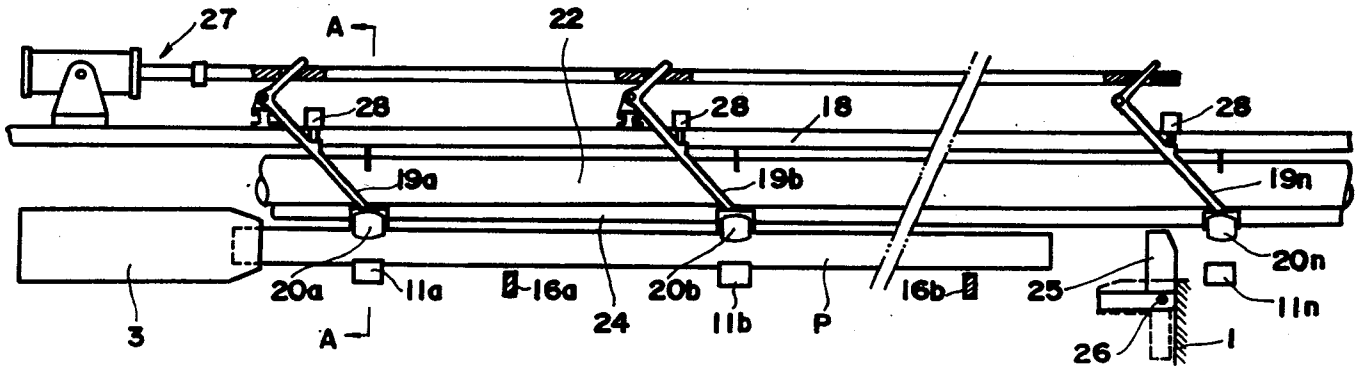
FIG. 2 is a side view of FIG. 1.
Figure 3:
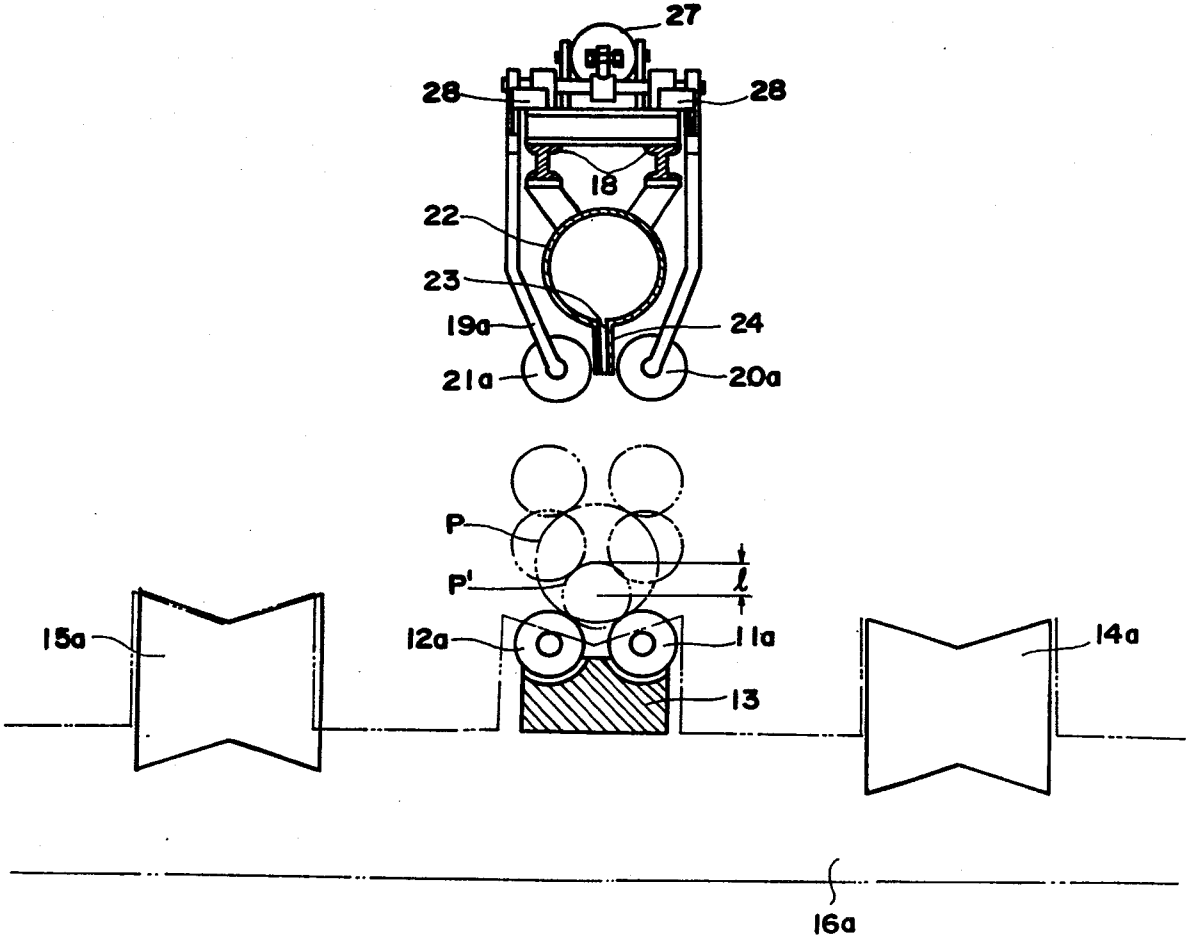
FIG. 3 is an enlarged sectional view taken along the line A—A of FIG. 2.

Referring to FIGS. 1 to 3, numeral 1 designates a quenching floor constructed to have a length of about 30 m so as to quench steel pipes ranging from short pipes to long pipes. Numerals 11*a*, 11*b*, ... , 11*n* and 12*a*, 12*b*, ..., 12*n* designate support rolls for a steel pipe P, which are arranged at given intervals on bases 13 fixedly mounted on the quenching floor 1. Numerals 14*a*, 14*b*, ..., 14*n* and 15*a*, 15*b*, ..., 15*n* designate axial pipe feed rolls which are respectively arranged along the support rolls 11*a* to 11*n* and 12*a* to 12*n*, respectively, at a given distance apart therefrom. Numerals 16*a*, 16*b*,.., 16*n* designate walking beams for transferring the pipe transversely, which are driven by a drive mechanism 17. Numeral 18 designates supporting members arranged to extend in the lengthwise direction of the quenching floor 1 and above the support rolls 11*a* to 11*n* and 12*a* to 12*n* and having arms 19*a*, 19*b*, ..., 19*n* which are arranged opposite to the support rolls 11*a* to 11*n* and 12*a* to 12*n*, respectively. Clamp rolls 20*a*, 20*b*, ..., 20*n* and 21*a*, 21*b*, ..., 21*n* are respectively mounted on the lower part of the arms 19*a* to 19*n*. A water supply pipe 22 is arranged on the supporting members 18 and an outer surface quenching unit including a smooth nozzle 24 is provided at a slit 23 formed in the lower surface of the pipe 22 in the lengthwise direction thereof. The arms 19*a*, 19*b*, ..., 19*n* are arranged so as to make a vertical rotary movement through a drive mechanism 27. Any given upper limit position is set by upper limit setters 28 for the arms 19*a*, 19*b* ..., 19*n* so as to reduce the operating distance in accordance with variations in the outer diameter of steel pipes to be quenched. Numeral 25 designates a drain board pivoted by a pin 26 to the quenching floor 1 so as to be rotated about the pin 26.

Figure 4:
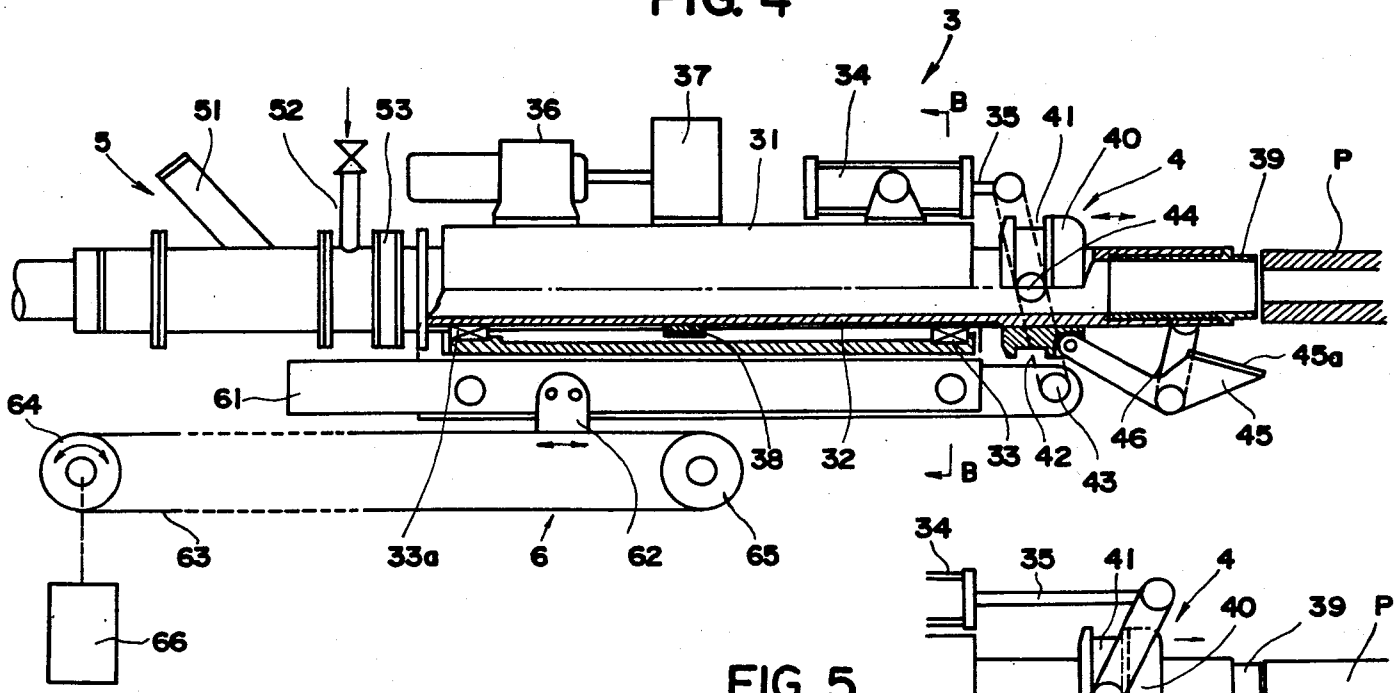
FIG. 4 is a side view showing, part in section, an embodiment of the quenching head used with the invention.

In FIG. 4 showing an inner surface quenching head 3, numeral 31 designates a head proper, and 32 a cylinder rotatably arranged inside the head proper 31 by means of bearings 33 and 33*a*. Numeral 34 designates a hydraulic cylinder mounted on the upper part of the head proper 31, 36 a motor, and 37 a reduction gear for reducing the output of the motor 36 whose gear (not shown) is in mesh with a gear 38 which is fixedly mounted on the outer surface of the cylinder 32. Numeral 39 designates a nozzle fitted in the forward end of the cylinder 32, which can be changed in accordance with the outer diameter of a steel pipe to be quenched.

Numeral 4 designates a clamping mechanism provided at one end of the cylinder 32. Numeral 40 designates a movable element fitted on the cylinder 32 by means of a key and key way, spline or the like so as to be slidable only in the axial direction and it has a groove 41 formed in the outer surface thereof. Numeral 42 designates a lever having its one end connected to an operating rod 35 of the hydraulic cylinder 34 and its other end rotatably connected to the head proper 31 by a pin 43. Numeral 44 designates a pin provided substantially at the middle of the lever 42 and fitted in the groove 41 of the movable element 40. Numeral 45 designates a clamp arm formed into substantially an L shape and connected to the movable element 40, and a lever 46 connected at its one end to the cylinder 32 is connected at its other end to substantially the central portion of the clamp arm 45. Numeral 45*a* designates a clamp shoe fitted on the forward end of the clamp arm 45. While only one set of the clamp arm 45 and the lever 46 is shown, at least two sets of them must be arranged on the outer surface of the cylinder 32.

Figure 5:
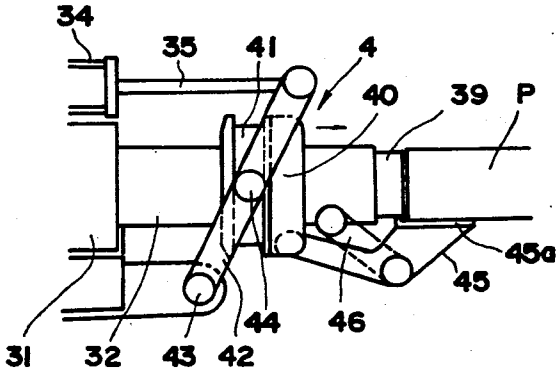
FIG. 5 is a side view useful for explaining the operation of the clamping mechanism of the quenching head shown in FIG. 4.

The clamp mechanism 4 is designed so that when the operating rod 35 of the hydraulic cylinder 34 is moved forward as shown in FIG. 5, the lever 42 is rotated clockwise about the pin 43 and thus the movable element 40 connected to the lever 42 by the pin 44 is moved forward. When the movable element 40 is moved forward, the clamp arms 45 are rotated counterclockwise by the levers 46 and thus the steel pipe P and the nozzle 39 are clamped by the clamp shoes 45*a*.

Numeral 5 designates a water supply pipe, 51 a valve for controlling the rate of water flow, and 52 a pipe connected to a source of air pressure (not shown) to supply air to the cylinder 42. The water supply pipe 5 and the cylinder 32 are connected watertight to each other by a coupling 53 so as to allow only the cylinder 32 to rotate.

Numeral 6 designates a drive mechanism for moving the quenching head 3 in the axial direction, which comprises an arm 62 fastened to a member 61 coupled to the head proper 31 and a chain 63 connected to the arm 62. One of sprockets 64 is driven by a reversible motor 66 to rotate in either direction. As a result, the quenching head 3 is moved in either direction (axial direction) by way of the arm 62 connected to the chain 63 and the member 61.

Figure 6:
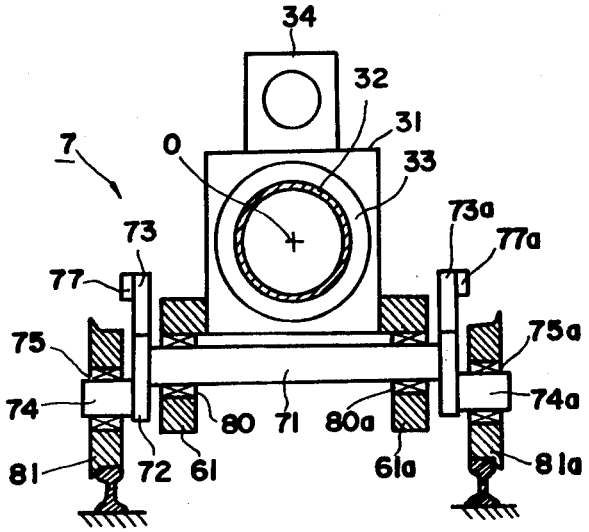
FIG. 6 is a sectional view taken along the line B—B of FIG. 4, showing an embodiment of centering mechanism used with the invention.
Figure 7:
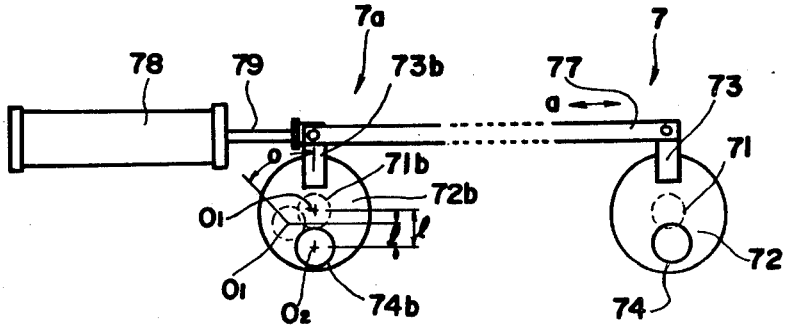
FIG. 7 is a side view showing a principal part of FIG. 6.

FIG. 6 is a sectional view taken along the line B—B of FIG. 4, and FIG. 7 is a side view of a principal part of FIG. 6. Numeral 7 designates a centering mechanism of the quenching head 3 for steel pipes P of different outer diameters. Numeral 71 designates a supporting shaft supported in bearings 80 and 80*a* which are mounted in the members 61 and 61*a*, respectively, and the head proper 31 is mounted on the supporting shaft 71. Numerals 72 and 72*a* designate cranks fitted on the ends of the supporting shaft 71 and having arms 73 and 73*a*, respectively. Numerals 74 and 74*a* designate crankshafts which are respectively fixed to the cranks 72 and 72*a* at positions eccentric by l with the center of the supporting shaft 71, and the crankshafts 72 and 72*a* are respectively supported in bearings 75 and 75*a* of wheels 81 and 81*a* respectively. At least two units of the centering mechanism 7 are provided at suitable intervals on the head proper 31. Numeral 77 designates a rod interconnecting the arms 73 and 73*b* of the front and rear centering mechanisms 7 and 7*a*, and 78 a hydraulic cylinder having an operating rod 79 connected to the rod 77 or the arm 73*b*.

With the centering mechanisms 7 and 7*a* constructed as described above, in the condition of FIG. 7 the arms 73 and 73*b* are at their highest positions so that the center $0_1$ of the supporting shafts 71 and 71*b*, respectively, is apart by the distance l from the center $0_2$ of the crankshafts 74 and 74*b*, respectively. Then, as the hydraulic cylinder 78 is operated so that the rod 77 is displaced in the direction of an arrow a, for example, the crank arms 73 and 73*b* connected to the rod 77 are respectively rotated counterclockwise about the crankshafts 74 and 74*a*. As a result, the supporting shafts 71 and 71*b* are also moved and thus their centers $0_1$ are displaced to $0_1'$. Consequently, the center distance between the supporting shafts 71 and 71*b* and the crankshafts 74 and 74*b* becomes $l_1$ and thus the center 0 of the head proper 31 is lowered by an amount $(l-l_1)$ With the construction described above, the operation of the invention will now be described. It is assumed that the invention is applied to the quenching of large-diameter steel pipes and that the center 0 of the quenching head cylinder 32 is in alignment with the center of a steel pipe to be quenched. As shown in FIG. 1, the steel pipe P introduced from the preceding processing stage is fed axially over the quenching floor 1 by the feed rolls 14a to 14*n* so that the pipe 1 strikes against a stopper 1*a* and it is stopped there. When this occurs, the walking beams 16*a* to 16*n* come into operation so that the steel pipe P is fed in the transverse direction and placed on the support rolls 11*a* to 11*n* and 12*a* to 12*n*. Then, as shown in FIGS. 2 and 3, the arms 19*a*, 19*b*, ..., 19*n* are lowered and the steel pipe P is lightly clamped by the clamp rolls 20*a* to 20*n* and 21*a* to 21*n*. On the other hand, as shown in FIG. 5, the forward end of the steel pipe P is clamped by the clamping mechanism 4 such that its end face is pressed against the end face of the nozzle 39.

In this case, the cooling water is supplied to the steel pipe P from the water supply pipe 5 through the cylinder 32 and also the cooling water is supplied to the water supply pipe 22 provided on the supporting members 18 thus causing the cooling water to flow down in laminar form over the entire length of the outer surface of the steel pipe P from the smooth nozzle 24. Then, the motor 36 is operated so that the cylinder 32 and the steel pipe P coupled to the former are rotated by way of the gear 38 and the whole inner and outer surfaces of the steel pipe P are cooled uniformly. At the same time, the quenching head 3 and the steel pipe P are axially moved to the left and right by the drive mechanism 6 and the pipe portions hidden by the support rolls 11*a* to 11*n* and 12*a* to 12*n* and the cramp rolls 20*a* to 20*n* and 21*a* to 21*n* are cooled.

After the inner and outer surfaces of the steel pipe P have been cooled for a given period of time, the water supply is stopped by the valve 51 and then air is supplied to the cylinder 32 and the steel pipe P from the air supply pipe 52. The purpose of this air supply is to prevent the cylinder 32 from being broken by a vacuum which will be created within the cylinder 32 upon sudden stoppage of the water supply and also to discharge the cooling water within the steel pipe P. The water discharged from the steel pipe P is diverted by the drain board 25 and discharged to below the quenching floor 1. Also, at the same time that the water supply into the steel pipe P is stopped, the water supply to the water supply pipe 22 provided on the supporting members 18 is stopped.

When the above-mentioned operation is completed, the operating rod 35 of the hydraulic cylinder 34 is moved backward so that the clamping mechanism 4 is released, and then the steel pipe P is transferred onto the following feed rolls 15*a* to 15*n*. At this time, the next steel pipe $P_1$ has been transferred onto the feed rolls 14*a* to 14*n* so that simultaneously with the transfer of the quenched steel pipe P, the next steel pipe $P_1$ is transferred onto the support rolls 11*a* to 11*n* and 12*a* to 12*n*. Note that the quenched steel P is transferred to the following processing stage (e.g., a straightener).

Next, the operation of the invention for quenching steel pipes of different pipe diameters will be described. The support rolls 11*a* to 11*n* and 12*a* to 12*n* provided on the quenching floor 1 are mounted on the fixed bases 13 and therefore the level of these rolls is always maintained constant. As a result, there will be a difference in pipe center position between the cases where large diameter pipes are quenched and where small and medium diameter pipes are quenched and thus it is impossible to clamp the pipes of different diameters in the quenching head 3 as such.

For this reason, where steel pipes having for example small pipe diameters are to be quenched, the nozzle 39 of the quenching head 3 is replaced by one having a small inside diameter and also the centering mechanisms 7 described in reference to FIGS. 6 and 7 are operated so that the cranks 72 are rotated a certain angle $\theta$ corresponding to the pipe diameter thereby lowering the head proper 31 and thus the center 0 of the cylinder 32 is aligned with the center of the steel pipe P. In this case, the flow rate of water from the water supply pipe 5 and the water supply pipe 22, respectively, is suitably adjusted in accordance with the outside and inside diameters of the steel pipe P.

In accordance with the embodiment of the quenching method of this invention, steel pipes of varying sizes from 114.3 to 244.5 mm in outside diameter and from 4.5 to 25 mm in wall thickness were quenched with an inner water flow rate of 10 m/sec max and an outside laminar flow rate of 500 T/H thereby obtaining excellent results, i.e., quenching cooling rates of over 50° C./sec and warpages of less than 10 mm/10 m as compared with the cooling rate of 32° C./sec and pipe warpage of 60 mm/10 m in the case of a so-called dip quenching and the cooling rate of 55° C./sec and pipe warpage of 35 mm/10 m in the case of a quenching by dipping plus inner water supply (the test pipe was 244.5 mm in outside diameter and 13.5 mm in wall thickness in both of the cases).

While, in the above-described embodiment, the inner and outer surfaces of the steel pipe are quenched, the present invention is also applicable to the inner surface quenching in which only the inner surface of pipes is cooled and the outer surface quenching in which only the outer surface of pipes is cooled. In the case of the inner surface quenching, it may be sufficient to effect only the rotation of pipes. Further, at least the support rolls at one place may be driven into rotation so as to reduce the occurrence of a twist in a pipe during the rotation of the quenching head. Still further, it is possible to arrange so that the crank units are rotatably coupled to the quenching head proper and the quenching head proper is held firmly in place thereby rotating a pipe through the operation of the support rolls. Still further, while the individual operations, e.g., introduction and clamping, water supply, rotation and axial movement of pipe, stoppage of water supply, air supply, releasing of clamps, transfer of pipe to a following processing stage, etc., have been described, it is needless to say that the series of operations associated with the quenching operation can be performed automatically. Still further, while the respective mechanisms of the quenching apparatus according to the invention have been described in terms of the illustrated embodiment, the present invention is not intended to be limited thereto and it is possible to use other mechanisms provided that they perform the same functions and produce the same effects. Still further, by arranging the level of the line of the quenching head below the transfer line (by providing a pit), it is possible to conveniently dispose the waste water. From the foregoing description it will be seen that the present invention has the following remarkable effects.

(1) The quenching apparatus can be incorporated as an in-line equipment in a steel pipe production line thereby decreasing the operating time.

(2) The cooling is effected from both the inner and outer surfaces of a steel pipe thereby cooling the entire length of the pipe uniformly.

(3) Further, the steel pipe is moved in the axial direction while rotating it during the quenching thereby more uniformly cooling the pipe than previously.

(4) Since the end face of the steel pipe is pressed against the quenching head, the cooling water velocity within the steel pipe can be made sufficiently high. Thus, long steel pipes can also be quenched easily.

(5) By virtue of the centering mechanisms, the center of the quenching head can be easily aligned with the center of steel pipes having different pipe diameters and thus the necessary arrangements can be made easily making it possible to use the apparatus in a wide range of applications.

(6) Since air is applied into the cylinder at the same time that the supply of water is stopped, there is no danger of the quenching head being damaged by a vacuum created upon stopping the water supply.

(7) The amount of cooling water used is relatively small.

What is claimed is:

1. An integral quenching apparatus for steel pipes comprising:

(a) transfer means whereby a steel pipe to be quenched and introduced in a lengthwise direction is capable of being transferred in a transverse direction, as well as aligned with an inner surface quenching head; said quenching head capable of moving reciprocatingly in the axial direction of such a steel pipe.

(b) outer surface quenching means arranged vertically above said transfer means and including a plurality of vertically movable clamp rolls situated below a smooth lip-shaped nozzle with said nozzle opening extending substantially over the entire length of a steel pipe to be quenched by spraying cooling water in laminar form over same entire length of a steel pipe to be quenched;

(c) said inner surface quenching head including cylinder means having a nozzle at one end and rotatably coupled at the other end to a water supply pipe, clamping means arranged on the periphery of said cylinder means capable of clamping one end of a steel pipe with the foreward end of said nozzle pressed to the end face of such a steel pipe, with means for rotating said cylinder means; and (d) a mechanism for moving said inner surface quenching head reciprocatingly in the axial direction together with the steel pipe.

2. An apparatus according to claim 1, wherein said clamping means comprises movable means fitted on said cylinder means to be slidable axially, a plurality of clamping arms each thereof being pivotally attached to said movable means at one end and connected to a lever pivotally attached to said cylinder means at the intermediate portion thereof and means for sliding said movable means along said cylinder means, whereby the end of a steel pipe is capable of being clamped by the free ends of said plurality of clamping arms.

3. An apparatus according to claim 1, wherein said mechanism for reciprocating motion comprises quenching head centering means including a plurality of cranks each having a wheel, a supporting shaft arranged in a lateral direction between said cranks at a position deviated from the rotation center of said wheel for supporting said cylinder means, and a mechanism for moving said plurality of cranks simultaneously around the rotation of said wheel.

* * * * *